US007878259B2

(12) United States Patent
Gauthier

(10) Patent No.: US 7,878,259 B2
(45) Date of Patent: Feb. 1, 2011

(54) DISPOSABLE TUBULAR FIRE EXTINGUISHER

(76) Inventor: Noel L. Gauthier, 8792 Mainville Rd., Mainville, OH (US) 45039

( * ) Notice: Subject to any disclaimer, the term of this patent is extended or adjusted under 35 U.S.C. 154(b) by 386 days.

(21) Appl. No.: 11/983,421

(22) Filed: Nov. 8, 2007

(65) Prior Publication Data

US 2009/0120654 A1 May 14, 2009

(51) Int. Cl.
*A62C 35/58* (2006.01)

(52) U.S. Cl. ..... 169/77; 169/9; 169/71; 169/85; 239/71; 239/337; 239/373; 222/399; 222/635

(58) Field of Classification Search ..... 169/9, 169/28, 30, 33, 71, 77, 84, 85, 88; 239/71, 239/337, 373, 589; 222/399, 635
See application file for complete search history.

(56) References Cited

U.S. PATENT DOCUMENTS

| | | | | | |
|---|---|---|---|---|---|
| 1,638,729 | A | * | 8/1927 | Friedrich | 169/77 |
| 1,815,494 | A | * | 7/1931 | Camp | 169/77 |
| 2,067,829 | A | | 1/1937 | Denne | |
| 2,120,248 | A | | 6/1938 | Hinchman | |
| 2,430,470 | A | * | 11/1947 | Keefe, Jr. et al. | 169/77 |
| 2,525,742 | A | * | 10/1950 | Weiss et al. | 169/33 |
| 2,610,692 | A | * | 9/1952 | Seaberg | 169/77 |
| 2,772,744 | A | | 12/1956 | Beaudet | |
| 2,785,759 | A | | 3/1957 | Fleming et al. | |
| 2,865,458 | A | | 12/1958 | Simoncini et al. | |
| 3,648,898 | A | | 3/1972 | Day | |
| 3,656,659 | A | | 4/1972 | Ishida | |
| 3,724,961 | A | | 4/1973 | Levoin | |
| 3,887,108 | A | | 6/1975 | McDaniel et al. | |
| 3,889,758 | A | * | 6/1975 | Dunn | 169/88 |
| 4,006,780 | A | | 2/1977 | Zehr | |
| 4,159,744 | A | | 7/1979 | Monte et al. | |
| 4,620,598 | A | | 11/1986 | Reeder | |
| 4,650,004 | A | | 3/1987 | Wendling et al. | |
| 5,305,957 | A | * | 4/1994 | Szocs | 169/85 |
| 5,441,114 | A | | 8/1995 | Spector et al. | |
| 5,676,190 | A | | 10/1997 | Matsumoto et al. | |
| 5,704,428 | A | | 1/1998 | Asano | |
| 5,848,649 | A | | 12/1998 | Matsumoto et al. | |
| 6,089,326 | A | | 7/2000 | Drakin | |
| 6,138,768 | A | | 10/2000 | Fujiki | |
| 6,189,623 | B1 | | 2/2001 | Zhegrov et al. | |
| 2006/0175067 | A1 | * | 8/2006 | Cover et al. | 239/71 |

FOREIGN PATENT DOCUMENTS

| | | |
|---|---|---|
| WO | WO 88/03037 | 5/1988 |
| WO | WO 02/26328 A1 | 4/2002 |

* cited by examiner

*Primary Examiner*—Steven J Ganey
(74) *Attorney, Agent, or Firm*—Baker & Hostetler LLP

(57) ABSTRACT

One embodiment of the invention is a hand-held fire extinguisher including: a tube having an open outlet end, an outer surface, and an inner surface; a fire suppressant composition provided within the tube; a propellant source containing a propellant, having a propellant outlet, where the propellant outlet is distal from the open outlet end of the tube and from the fire suppressant composition, and where the propellant outlet is in fluid communication with the fire suppressant composition and the open outlet end of the tube; and an actuator for the propellant source. In such apparatus, actuation of the actuator allows propellant flow from the propellant outlet passing through the fire suppressant composition and out through the open outlet end of the tube.

18 Claims, 6 Drawing Sheets

DISPOSABLE TUBULAR FIRE EXTINGUISHER

BACKGROUND

Conventional fire extinguishers tend be complicated and bulky. Their numerous parts make them expensive to produce and maintain. Their size and shape make them costly to ship in bulk over long distances. Additionally, the materials used in a conventional fire extinguisher, which often include metallic parts, presents a significant waste disposal problem.

It would be desirable to provide a fire extinguisher that is relatively low cost, easily manufactured, capable of long term storage, conveniently packaged for shipping, and easier to dispose of in a more environmentally friendly manner. Such a fire extinguisher could be used in low income areas, distributed by aid agencies in areas prone to catastrophic fires, and generally used where conventional fire extinguishers are too expensive to purchase, distribute, and maintain.

SUMMARY

The present invention includes a cylindrical tube having an open outlet. In the given embodiment, the tube is fashioned from paperboard. The tube has an inner circumferential surface within the tube. The inner circumferential surface is coated by a fire suppressant composition. The open outlet includes a nozzle mounted thereto for directing and concentrating the flow of fire suppressant compositions being expelled there from. A propellant housing is coupled to the opposing end of the paperboard tube in the present embodiment. In this embodiment, the propellant housing is cylindrical and made of plastic. The propellant housing has an outer circumferential diameter that is substantially the same as the outer circumferential diameter of the paperboard tube such that, when coupled together, the two components form a generally continuous outer surface. Within the propellant housing, is a propellant source and an actuator mechanism.

In a first aspect of the invention, the invention is a hand-held fire extinguisher including: a tube having an open outlet end, an outer surface, and an inner surface; a fire suppressant composition provided within the tube; a propellant source containing a propellant, having a propellant outlet, where the propellant outlet is distal from the open outlet end of the tube and from the fire suppressant composition, and where the propellant outlet is in fluid communication with the fire suppressant composition and the open outlet end of the tube; and an actuator for the propellant source. In such apparatus, actuation of the actuator allows propellant flow from the propellant outlet passing through the fire suppressant composition and out through the open outlet end of the tube.

Further detailed embodiments may include embodiments wherein one or more of the following applies: the tube is cylindrical; the tube is formed from paperboard; the actuator is a depressible button, a depressible latching button, or a threaded device; the fire suppressant composition is a dry fire suppressant composition; the dry fire suppressant includes a carbonate; the dry fire suppressant includes potassium carbonate; the dry fire suppressant coats the inner surface of the tube and has a hollow air passage extending axially there through; the propellant carries at least a portion of the fire suppressant composition with it as it passes through the fire suppressant composition and out through the outlet end of the tube; the propellant is contained within a canister; the propellant is a liquefied gas; the propellant is inert; the propellant includes carbon dioxide; the extinguisher has a waterproof wrapper enveloping the outer surface of the tube; the waterproof wrapper is labeled with symbols signifying purpose and method of operation; the waterproof wrapper is labeled with textual characters and words signifying purpose and method of operation; the waterproof wrapper has a removable segment covering the actuator; the removable segment is a perforated tear-off tab; the tube is about 2-3 inches in diameter; the tube is about 23-25 inches in length; the tube is formed from a plurality of secondary tubes including a first tube containing the fire suppressant composition and a second tube containing the actuator and the propellant, wherein the second tube is attached opposite the outlet end of the tube.

In a second aspect of the invention, the invention is a hand-held fire extinguisher including: a tube having an open outlet end, an outer surface, and an inner surface; a fire suppressant composition provided within the tube; a propellant source containing a propellant, having a propellant outlet, where the propellant outlet is distal from the open outlet end of the tube and from the fire suppressant composition, and where the propellant outlet being in fluid communication with the fire suppressant composition and the open outlet end of the tube; and an actuator for the propellant source; where no part of the fire suppressant composition or the propellant source extends radially beyond the outer diameter of the tube. In a further detailed embodiment, the actuator does not extend radially beyond the outer diameter of the tube.

In a third aspect of the invention, the invention is a hand-held fire extinguisher including: a tube having an open outlet end, an outer surface, and an inner surface; a fire suppressant composition provided within the tube; a propellant source containing a propellant, having a propellant outlet, where the propellant outlet is distal from the open outlet end of the tube and from the fire suppressant composition, and where the propellant outlet is in fluid communication with the fire suppressant composition and the open outlet end of the tube; and an actuator for the propellant source; where the tube is substantially biodegradable. In a further detailed embodiment, the tube is formed from paperboard. In a further detailed embodiment, the fire suppressant composition is environmentally benign. In a further detailed embodiment, the propellant is environmentally benign. In a further detailed embodiment, the propellant source includes a plastic housing.

In a fourth aspect of the invention, the invention is a hand-held fire extinguisher including: a tube having an open outlet end, an outer surface, and an inner surface; a first fire suppressant reactant provided within the tube; a propellant source containing a propellant, having a propellant outlet, where the propellant outlet is distal from the open outlet end of the tube and from the fire suppressant reactant, and where the propellant outlet is in fluid communication with the fire suppressant reactant and the open outlet end of the tube; and an actuator for the propellant source; wherein the propellant includes a second fire suppressant reactant. In this aspect of the invention, actuation of the actuator allows propellant flow from the propellant outlet passing through the first fire suppressant reactant and out through the open outlet end of the tube. In a further detailed embodiment, at least a portion of the second fire suppressant reactant reacts with the at least a portion of the first fire suppressant reactant upon passing through the first fire suppressant reactant.

In a fifth aspect of the invention, the invention is a hand-held fire extinguisher including: a tube having an open outlet end, an outer surface, and an inner surface; a first fire suppressant composition provided within the tube; a propellant source containing a propellant, having a propellant outlet, where the propellant outlet is distal from the open outlet end of the tube and from the fire suppressant composition, and where the propellant outlet is in fluid communication with the fire suppressant composition and the open outlet end of the tube; and an actuator for the propellant source; where the propellant includes a second fire suppressant composition.

In a sixth aspect of the invention, the invention is a hand-held fire extinguisher including: a paperboard tube having an open outlet end, an inner surface, and an outer surface; a dry fire suppressant composition coating the inner surface of the tube; a propellant source containing a propellant, having a propellant outlet, where the propellant outlet is distal from the open outlet end of the tube and from the fire suppressant composition, and where the propellant outlet is in fluid communication with the fire suppressant composition and the open outlet end of the tube; an actuator for the propellant source that includes, but is not limited to, a depressible latching button; and a waterproof wrapper enveloping the outer surface of the tube; where the wrapper has a removable tab covering the actuator. In a further detailed embodiment, the propellant carries at least a portion of the dry fire suppressant composition with it as it passes through the dry fire suppressant composition and out through the outlet end of the cylindrical tube. In a further detailed embodiment, the propellant reacts with the at least a portion of the dry fire suppressant composition upon passing through the dry fire suppressant composition.

DETAILED DESCRIPTION

Figure 1:
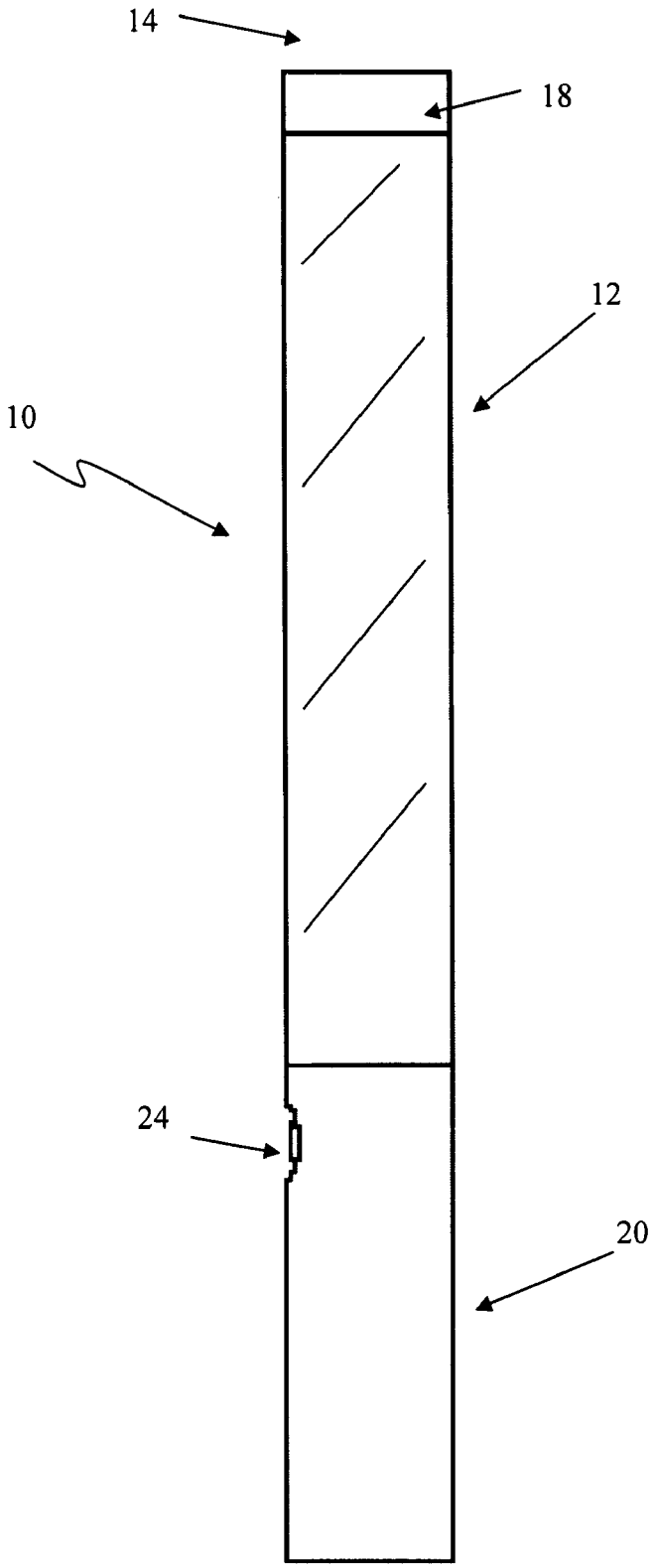
FIG. 1 is an external, side view of the fire extinguisher according to an exemplary embodiment of the present invention.
Figure 2:
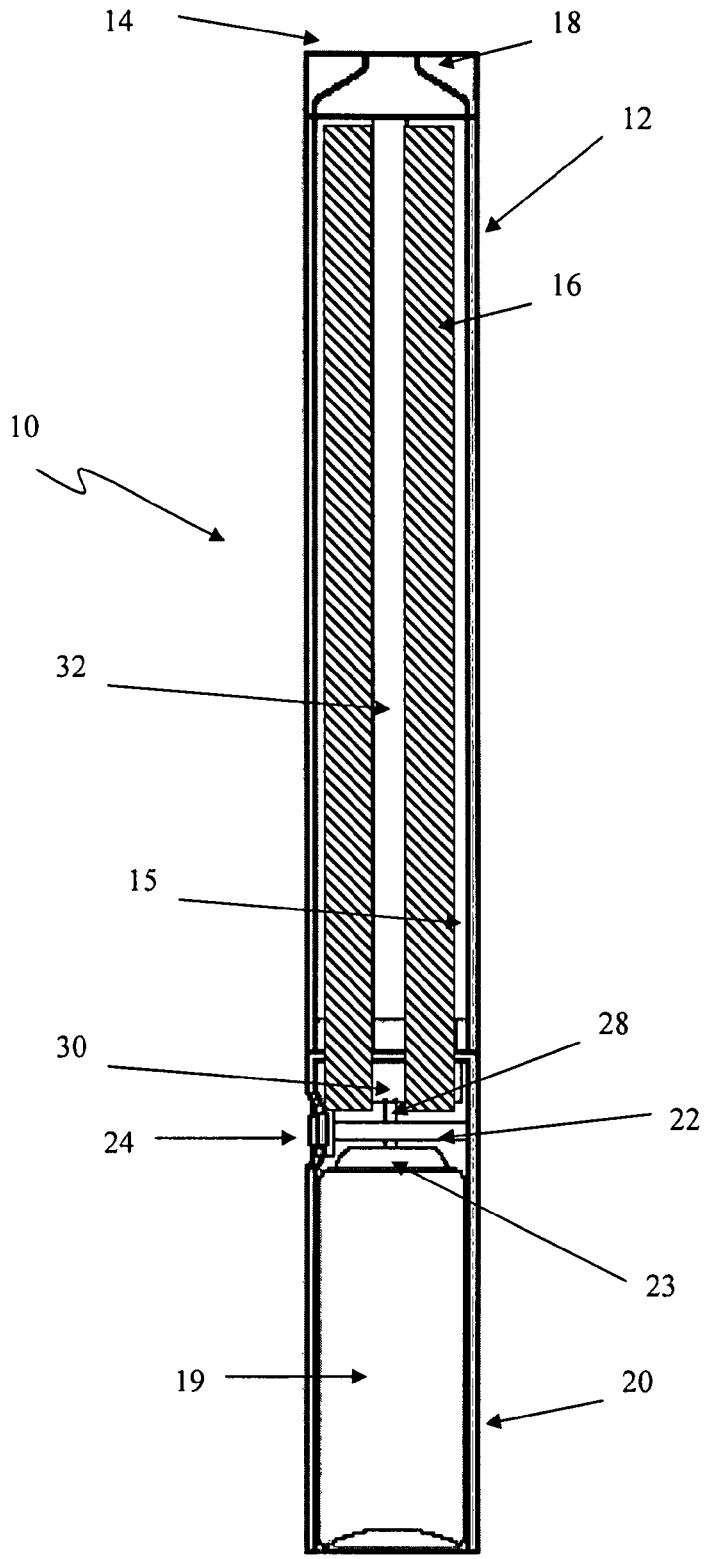
FIG. 2 is a longitudinal cross-section of the exemplary fire extinguisher.
Figure 3:
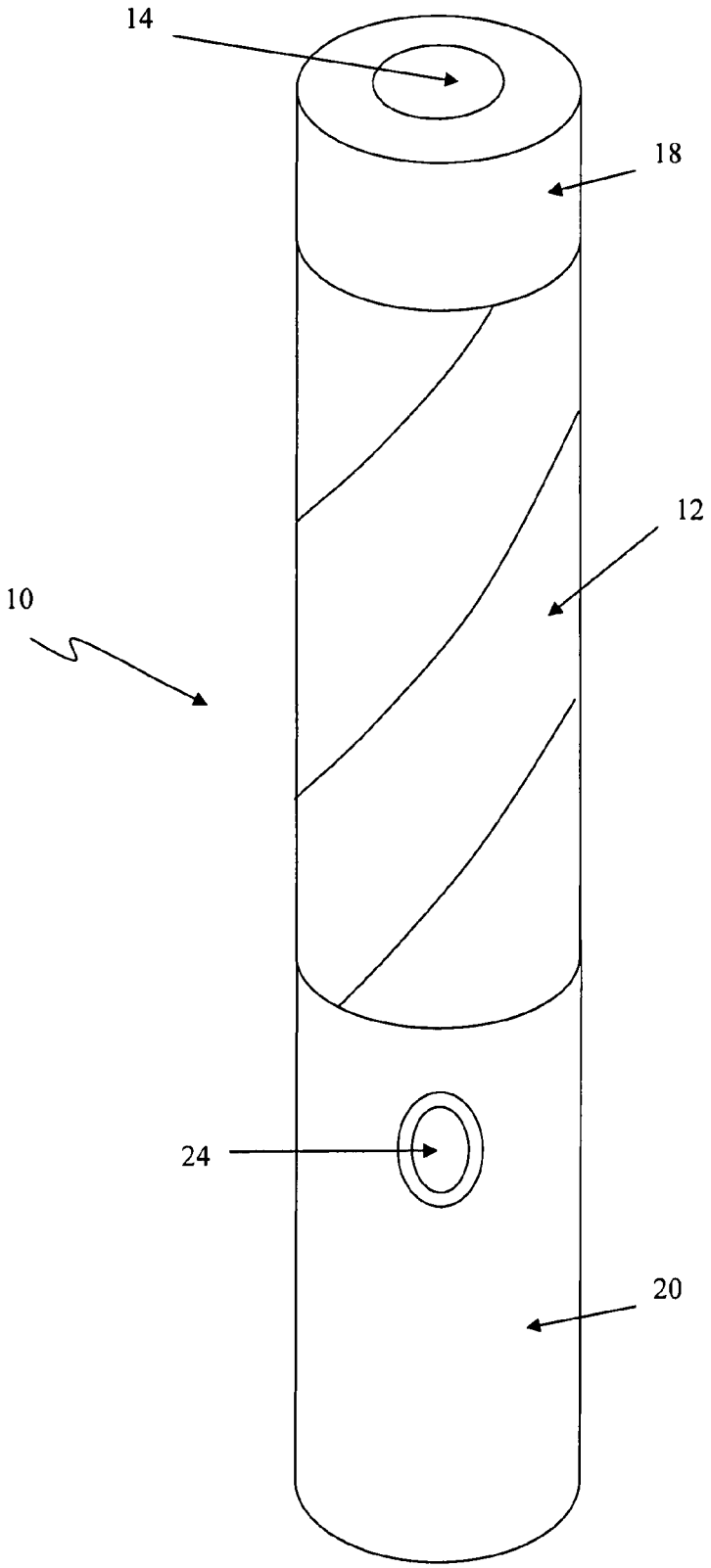
FIG. 3 is a perspective external view of the exemplary extinguisher.

As shown in FIG. 3, an exemplary fire extinguisher 10 according to the present invention includes a cylindrical tube 12 having an open outlet 14. In the given embodiment, the tube is fashioned from paperboard. The tube has an inner circumferential surface 15 within the tube. The inner circumferential surface is coated by a fire suppressant composition 16. The open outlet 14 includes a nozzle 18 mounted thereto for directing and concentrating the flow of fire suppressant compositions being expelled therefrom. A propellant housing 20 is coupled to the opposing end of the paperboard tube 12 in the present embodiment. In this embodiment, the propellant housing 20 is cylindrical and made of plastic. The propellant housing 20 has an outer circumferential diameter that is substantially the same as the outer circumferential diameter of the paperboard tube 12 such that, when coupled together, the two components form a generally continuous outer surface. Within the propellant housing 20 is a propellant source 19 and an actuator mechanism 22.

The actuator mechanism 22 includes an actuator button 24 exposed on the outer tubular surface of the propellant housing 20. The propellant source 19 has an outlet 23. The actuator button 24 is operatively coupled to the propellant source outlet 23, such that when the actuator button 24 is in its depressed state the propellant source outlet 23 opens, allowing propellant to be expelled from the propellant source 19 and when the actuator button 24 returns to its neutral state, the propellant source outlet 23 closes, terminating the expulsion of propellant therefrom. In the present embodiment, the actuator button 24 includes a latching mechanism such that when the button is pressed once, the button latches in the depressed state. To deactivate the actuator button 24, the button is pressed again to disengage the latching mechanism and a biasing force associated with the button returns the button to its neutral state. It would be apparent to those of ordinary skill in the art that such an actuator button, actuator mechanisms, and other mechanisms associated therewith are notoriously old and well known in the art, all of which fall within the scope of the present invention.

The propellant source outlet 23 is in fluid communication with an outlet port 28 of the propellant housing 18. This outlet port 28 is in fluid communication with an inlet port 30 of the paperboard tube 12. The fire suppressant composition 16, as described above, is coated to the inner circumferential surface of the paperboard tube 12 to provide an axial channel 32 extending completely therethrough between the inlet port 30 and the outlet end 14 of the paperboard tube 12, which is in fluid communication with the nozzle 18.

The fire suppressant composition 16, in the present embodiment, is potassium carbonate ($KCO_3$). In the present embodiment, the propellant, contained in the propellant source 19, is a liquefied mixture of carbon dioxide ($CO_2$) and Nitrogen ($N_2$). It would be apparent to those of ordinary skill in the art that other common fire suppressants, propellants, and combinations thereof are well known in the art. The use of other such well known suppressants, propellants, and combinations fall within the scope of the present invention.

Figure 4:
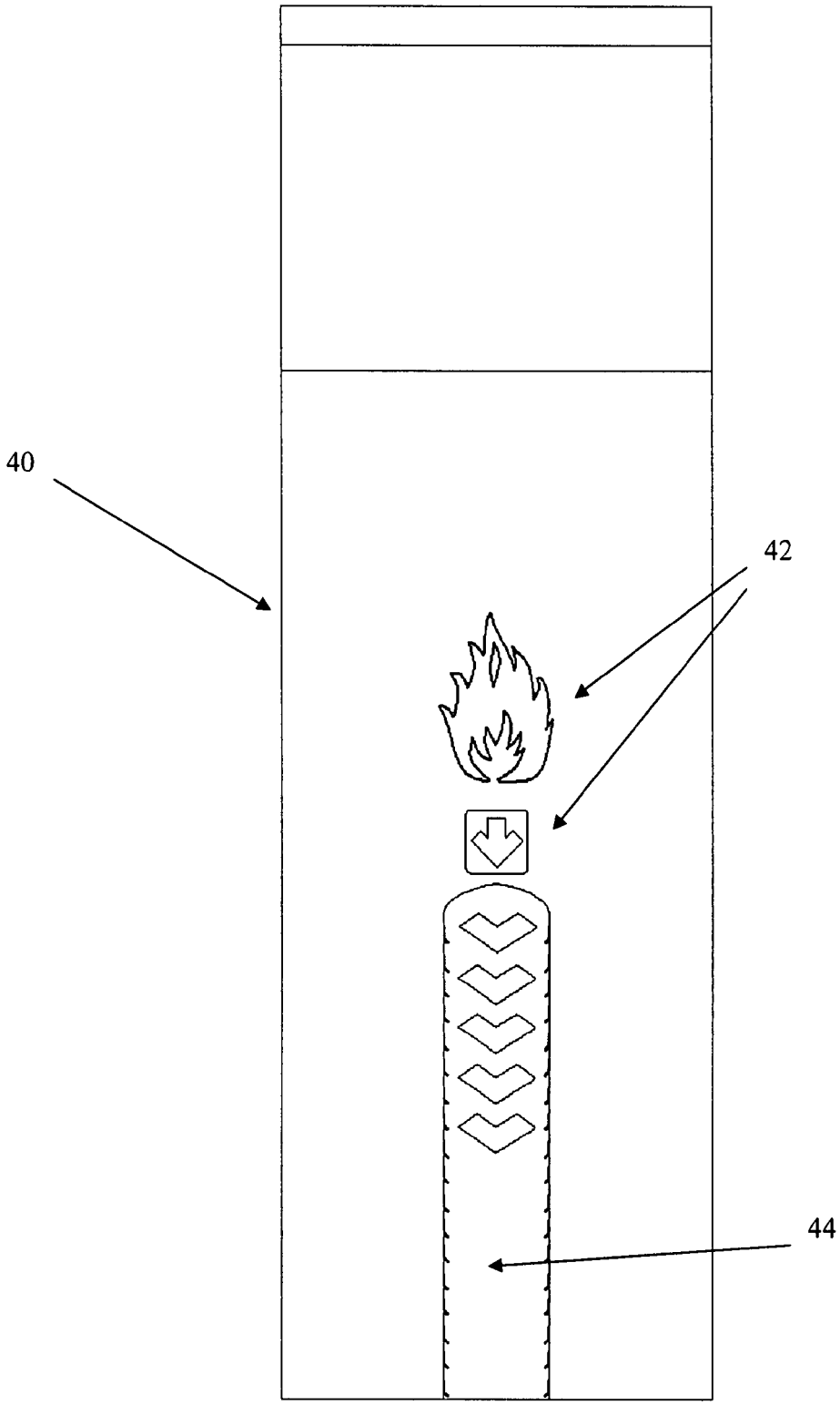
FIG. 4 is a view of an exemplary wrapper.
Figure 5:
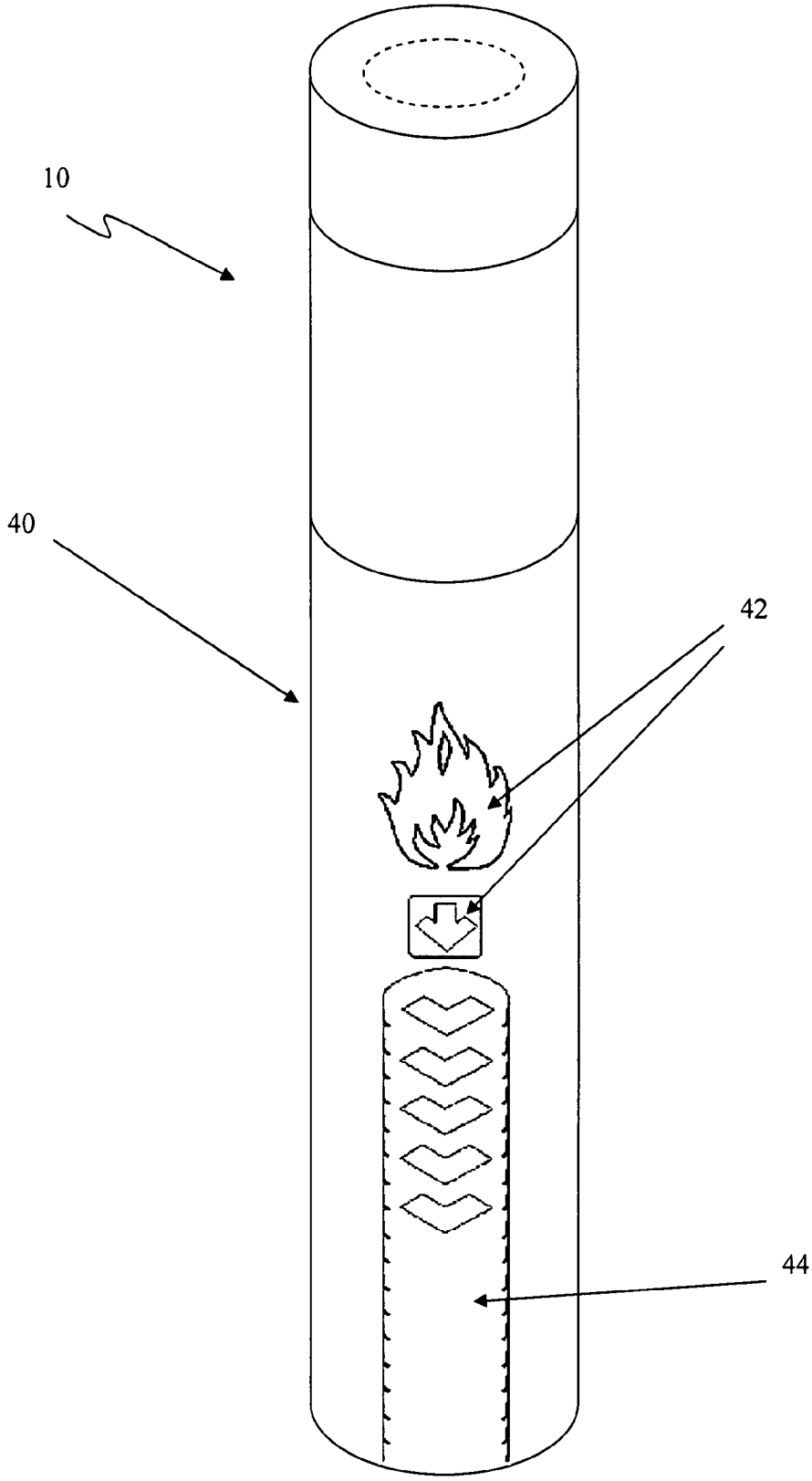
FIG. 5 is a perspective view of the exemplary wrapped fire extinguisher.
Figure 6:
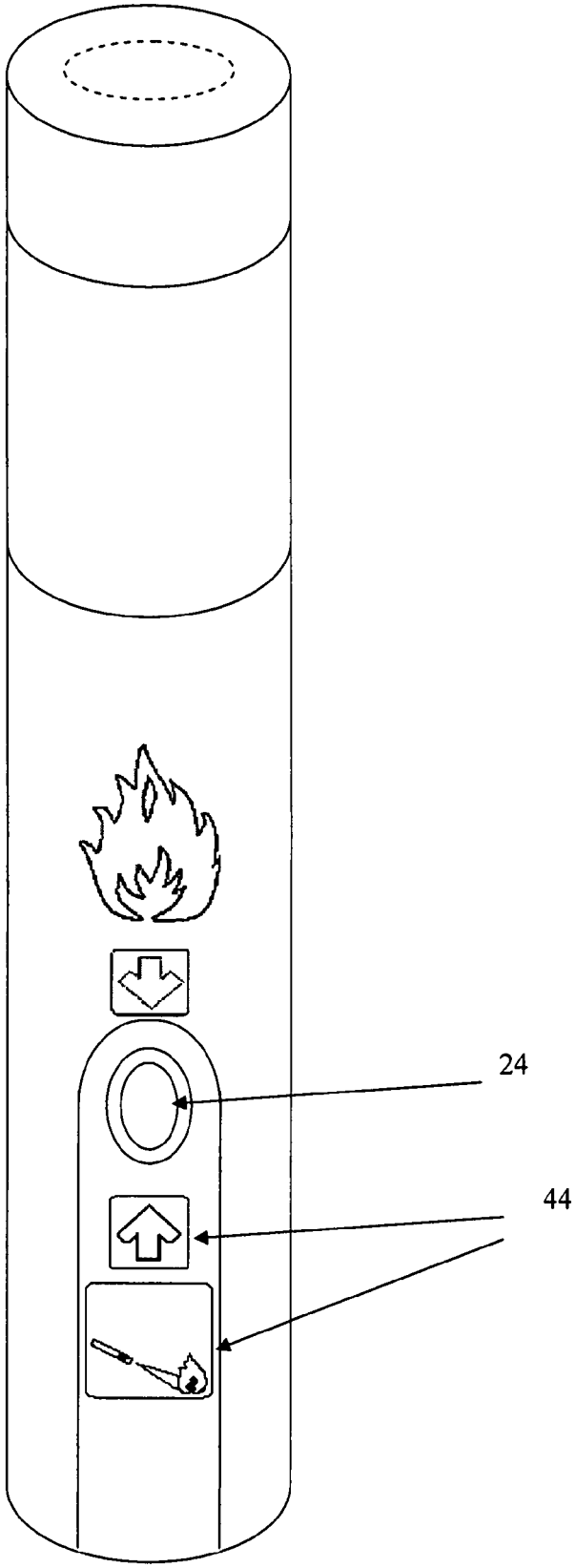
FIG. 6 is a perspective view of the exemplary wrapped fire extinguisher with the safety tab removed.

As shown in FIGS. 4, 5, & 6, the given embodiment may also be covered with a waterproof wrapper 40. As shown in FIG. 5, the wrapper 40 completely envelops the outer surface of the extinguisher. The wrapper 40 could be composed of any one or a combination of numerous types of thin, strong, waterproof materials. Additionally, as shown in FIG. 4 the wrapper has universally recognizable symbols 42 indicating the nature of and method for using the extinguisher. These universal symbols 42 would allow parties in many different locations and countries to use the extinguisher. In the exemplary embodiment, such universal symbols 42 include a flame, indicating fire, and a plurality of arrows, indicating the action the user should take. Additionally, the wrapper 40 could be printed in colors that generally symbolize fire related devices in a given region. In certain areas of the world this could be red, in other areas this could be a yellow green, or other appropriate color. Finally, the wrapper includes a safety mechanism to protect the actuator. In the exemplary embodiment, the safety mechanism is a tear off tab 44 that covers the actuator to prevent inadvertent actuation of the actuator. Once the tab is removed, as shown in FIG. 6, the actuator button 24 along with additional universal symbols 46 imprinted on the propellant housing 18 are exposed. In the exemplary embodiment, the universal symbols 46 include a fire diagram, indicating the method of use of the extinguisher, and an arrow, indicating the location of the actuator button 24.

The described embodiment is not intended to be limiting. Other embodiments fall within the scope of this invention. The tube may be formed of other materials including a biodegradable material, a biodegradable paperboard material, another material well known in the art, or a combination of any of these materials. The tube 12 and propellant housing 18 may be formed as one uniform component with an open outlet end. The fire suppressant composition 16 may be an environmentally inert composition. Additionally, the fire suppressant composition 16 may simply be contained within the tube 12, without being coated to the surface of the tube 15. The propellant may be any inert or fire suppressing propellant known in the art. Additionally, the fire suppressant composition 16 and the propellant may both be reactants, wherein the fire suppressant composition 16 and the propellant react with each other, in a reaction well known in the art, to form a new, well-known fire suppressant composition. This new fire suppressant composition may also be an environmentally inert fire suppressant composition. Other varieties of well-known actuators such as a simple, non-latching button, or a threaded actuator may be used. The wrapper 40 may be imprinted with directions in different languages in addition to or instead of the universal symbols 42. The tube 12 may have a round cross-section, a triangular cross-section, a square cross-section, or any other regular or irregular cross-sectional shape. In the case of a cross-section that is not round, the term "inner circumferential" or "outer circumferential" should be taken to mean the surface lying on the inner or outer wall surface of the tube, respectively.

The described embodiment is used according to the following steps. First, the safety tab 44 should be removed from the wrapper 40, exposing the actuator button 24. Second, the outlet 14 should be pointed at the flame or the source of the flame. Third, the button 24 should be depressed. Once the button 24 is depressed, the propellant will exit from the propellant source 19 and flow through the appropriate channel to the fire suppressant composition 16. The propellant will then mix with the fire suppressant composition. Together, the propellant and suppressant mixture will exit the outlet of the tube and be injected into the flame and onto the source of the flame, thereby extinguishing or mitigating the fire. Finally, the button 24 can be pressed again to stop the flow of propellant.

Following from the above description and invention summaries, it should be apparent to those of ordinary skill in the art that, while the apparatuses described herein constitute exemplary embodiments of the present invention, the invention is not limited to these precise embodiments and changes may be made to such embodiments without departing from the scope of the invention as defined by the claims. Additionally, it is to be understood that the invention is defined by the claims and it is not intended that any limitation or element describing the exemplary embodiments set forth herein is to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, as the invention is defined by solely by the claims and since inherent and/or unforeseen advantages of the present invention may exist even though they may not have been explicitly discussed herein.

What is claimed is:

1. A hand-held fire extinguisher comprising:

a tube having an open outlet end, an outer surface, and an inner surface;

a dry fire suppressant composition coating the inner surface of the tube and providing a hollow propellant passage extending axially therethrough, the dry fire suppressant composition being exposed to the propellant passage axially along at least a substantial axial length of the propellant passage;

a propellant source containing a propellant, having a propellant outlet, the propellant outlet being distal from the open outlet end of the tube and from the fire suppressant composition, and the propellant outlet being in fluid communication with the propellant passage extending through the coated dry fire suppressant composition and with the open outlet end of the tube; and an actuator for the propellant source;

whereby actuation of the actuator allows propellant flow from the propellant outlet passing through the propellant passage extending through the coated dry fire suppressant composition such that the propellant will mix with the fire suppressant, and such that the propellant and fire suppressant mixture will exit out through the open outlet end of the tube.

2. The hand-held fire extinguisher of claim 1 wherein the tube is cylindrical.

3. The hand-held fire extinguisher of claim 1 wherein the tube comprises paperboard.

4. The hand-held fire extinguisher of claim 1 wherein the actuator comprises one of:

a depressible button;

a depressible latching button; and a threaded device.

5. The hand-held fire extinguisher of claim 1 wherein the dry fire suppressant comprises a carbonate.

6. The hand-held fire extinguisher of claim 5 wherein the carbonate is potassium carbonate.

7. The hand-held fire extinguisher of claim 1 wherein the propellant carries at least a portion of the fire suppressant composition with it as it passes through the fire suppressant composition and out through the outlet end of the tube.

8. The hand-held fire extinguisher of claim 1 wherein the propellant source includes a plastic housing.

9. The hand-held fire extinguisher of claim 1 wherein the propellant is a liquefied gas.

10. The hand-held fire extinguisher of claim 1 wherein the propellant is inert.

11. The hand-held fire extinguisher of claim 1 wherein the propellant comprises carbon dioxide.

12. The hand-held fire extinguisher of claim 1 wherein the tube has an outer diameter of about 2.5 inches.

13. The hand-held fire extinguisher of claim 1 wherein the tube is about 23-25 inches in length.

14. The hand-held fire extinguisher of claim 1 wherein the tube comprises a plurality of secondary tubes including a first tube containing the fire suppressant composition and a second tube containing the actuator and the propellant, wherein the second tube is attached opposite the outlet end of the tube.

15. A hand-held fire extinguisher comprising:

a tube having an open outlet end, an outer surface, and an inner surface;

a fire suppressant composition provided within the tube;

a propellant source containing a propellant, having a propellant outlet, the propellant outlet being distal from the open outlet end of the tube and from the fire suppressant composition, and the propellant outlet being in fluid communication with the fire suppressant composition and the open outlet end of the tube;

an actuator for the propellant source; and a waterproof wrapper enveloping the outer surface of the tube, wherein the waterproof wrapper is labeled with symbols signifying purpose and method of operation; and wherein the waterproof wrapper has a removable segment covering the actuator;

whereby actuation of the actuator allows propellant flow from the propellant outlet passing through the fire suppressant composition and out through the open outlet end of the tube.

16. The hand-held fire extinguisher of claim 15 wherein the removable segment is a perforated tear-off tab.

17. A hand-held fire extinguisher comprising:

a tube having an open outlet end, an outer surface, and an inner surface;

a first fire suppressant reactant provided within the tube;

a propellant source containing a propellant, having a propellant outlet, the propellant outlet being distal from the open outlet end of the tube and from the first fire suppressant reactant provided within the tube, and the propellant outlet being in fluid communication with the first fire suppressant reactant provided within the tube and the open outlet end of the tube; and an actuator for the propellant source; and wherein the propellant includes a second fire suppressant reactant adapted to react with the first fire suppressant reactant to provide a fire suppressant composition;

whereby actuation of the actuator allows flow the second fire suppressant reactant from the propellant outlet passing through the first fire suppressant reactant provided within the tube such that the first and second fire suppressant reactants react to provide the fire suppressant composition which flows out through the open outlet end of the tube.

18. A hand-held fire extinguisher comprising:

a paperboard tube having an open outlet end, an inner surface, and an outer surface;

a dry fire suppressant composition coating the inner surface of the tube;

a propellant source containing a propellant, having a propellant outlet, the propellant outlet being distal from the open outlet end of the tube and from the dry fire suppressant composition, and the propellant outlet being in fluid communication with the dry fire suppressant composition and the open outlet end of the tube;

an actuator for the propellant source comprising a depressible latching button; and a waterproof wrapper completely enveloping at least an outer circumferential surface of the tube;

wherein the wrapper has a removable tab covering the actuator;

whereby actuation of the actuator allows propellant flow from the propellant outlet passing through the dry fire suppressant composition and out through the open outlet end of the tube.

* * * * *